US006854562B2

(12) United States Patent
Kwak

(10) Patent No.: US 6,854,562 B2
(45) Date of Patent: Feb. 15, 2005

(54) CLIMBING SAFETY DEVICE FOR TOWER CRANE

(76) Inventor: Sang Ho Kwak, 953-19, Bong-Cheon 1-dong KwanAk-gu, Seoul 151-829 (KR)

( * ) Notice: Subject to any disclaimer, the term of this patent is extended or adjusted under 35 U.S.C. 154(b) by 38 days.

(21) Appl. No.: 10/457,581

(22) Filed: Jun. 9, 2003

(65) Prior Publication Data

US 2004/0020719 A1 Feb. 5, 2004

(30) Foreign Application Priority Data

Jul. 31, 2002 (KR) ..... 2002-0022963

(51) Int. Cl.[7] ..... A62B 35/00

(52) U.S. Cl. ..... 182/8; 182/75; 182/231; 182/196

(58) Field of Search ..... 182/8, 70–75, 182/231, 236, 196–199

(56) References Cited

U.S. PATENT DOCUMENTS 458,023 A * 8/1891 Kimball et al. ..... 182/70
1,994,408 A * 3/1935 St. Pierre ..... 182/73
4,252,214 A * 2/1981 Miller ..... 182/8
4,550,804 A * 11/1985 Bummer ..... 182/233
4,997,064 A * 3/1991 Motte et al. ..... 182/231
5,161,639 A * 11/1992 Ice ..... 182/8

* cited by examiner

*Primary Examiner*—Alvin Chin-Shue
(74) *Attorney, Agent, or Firm*—Ladas & Parry LLP

(57) ABSTRACT

Disclosed is a climbing safety device in a tower crane including a vertical ladder enabling an operator to move to an overhead operator cab, and a wire rope for ensuring a safety of the operator. The climbing safety device includes a wire rope winding unit for winding or unwinding a wire rope. The wire rope has a ladder structure while being provided, at each side thereof, with engagement balls vertically spaced apart from one another. The climbing safety device also includes a safety unit for guiding a movement of the wire rope while controlling a sudden unwinding of the wire rope. The safety unit includes a sensor for sensing the sudden unwinding of the wire rope. This climbing safety device can provide a sense of security to the operator climbing up or down the tower crane by a wire rope being automatically wound and unwound, while immediately stopping the unwinding of the wire rope when the operator falls off a ladder of the tower crane, by operating the safety unit, thereby being capable of protecting the operator's life.

4 Claims, 5 Drawing Sheets

CLIMBING SAFETY DEVICE FOR TOWER CRANE

BACKGROUND OF THE INVENTION

1. Field of the Invention

The present invention relates to a climbing safety device for a tower crane, and more particularly to a climbing safety device for a tower crane which can immediately cope with an accident of an operator falling off a ladder of the tower crane, caused by a slip of the operator or a sudden change of weather conditions occurring when the operator climbs up or down the ladder, thereby protecting the operator's life.

2. Description of the Related Art

When a high-rise and large-scale building is constructed, a tower crane is generally used to carry construction materials to upper stories. As shown in FIG. 4, such a tower crane, which is denoted by the reference numeral 90, includes a mast 91 installed on a foundation to extend vertically, a horizontal box frame, that is, a jib 93, mounted to an upper end of the mast 91, and provided with a counterweight 92 so as to be maintained in a horizontal state, a turntable 94 mounted to an upper portion of the mast 91, and adapted to rotate the jib 93 left and right in accordance with rotation of a swing motor equipped therein, and an operator cab 95 installed on the turntable 94. In order to allow an operator to access the operator cab 95, a vertical ladder 96 is installed within the mast 91.

When the operator desires to access the operator cab 95 in order to operate the tower crane, he climbs up the vertical ladder 96 to enter the operator cab 95. After completion of desired tower crane operations, the operator climbs down the vertical ladder 96. In order to cope with an unexpected accident of the operator occurring during the climbing, a safety rope (not shown) is provided.

However, such a safety rope cannot secure a desired safety for protecting the operator's life when the operator falls off the ladder due to his slip, a sudden change of weather conditions in the winter season or rainy season, or strong wind, because it depends from the operator cab 95 to the foundation, and its lower end is simply firmly held on the body of the operator.

SUMMARY OF THE INVENTION

The present invention has been made in view of the above mentioned problem, and an object of the invention is to provide a climbing safety device for a tower crane which includes a safety unit capable of immediately stopping descent of a wire rope, connected to the body of an operator, caused when the operator falls off a ladder of the tower crane due to his slip or a sudden change of weather conditions, thereby protecting the operator's life, and a wire rope winding unit for winding and unwinding the wire rope at a constant speed, thereby being capable of providing a stable operating environment to the operator, while having a simple construction, so that it can be inexpensively installed.

In accordance with the present invention, this object is accomplished by providing, in a tower crane including a vertical ladder enabling an operator to move to an overhead operator cab, and a wire rope serving as safety means for the operator, a climbing safety device comprising: a wire rope winding unit installed at an upper portion of the tower crane, the wire rope winding unit including a drive motor adapted to freely rotate in a forward or backward direction, thereby winding or unwinding the wire rope, and a winch operatively connected to the drive motor; the wire rope having a ladder structure to have wires at both sides thereof, respectively, while being provided, at each side thereof, with engagement balls vertically spaced apart from one another along an associated one of the wires, the wire rope being fixed, at one end thereof, to the winch so as to be wound on the winch, and provided, at the other end thereof, with a connecting ring for connecting the wire rope to a certain body portion of the operator; and a safety unit installed beneath the wire rope winding unit, and adapted to guide a movement of the wire rope while controlling a sudden unwinding of the wire rope, the safety unit including a sensor for sensing the sudden unwinding of the wire rope.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENTS

Now, a climbing safety device for a tower crane according to the present invention, which can accomplish the above mentioned object, will be described in detail with reference to the annexed drawings.

Figure 1A:
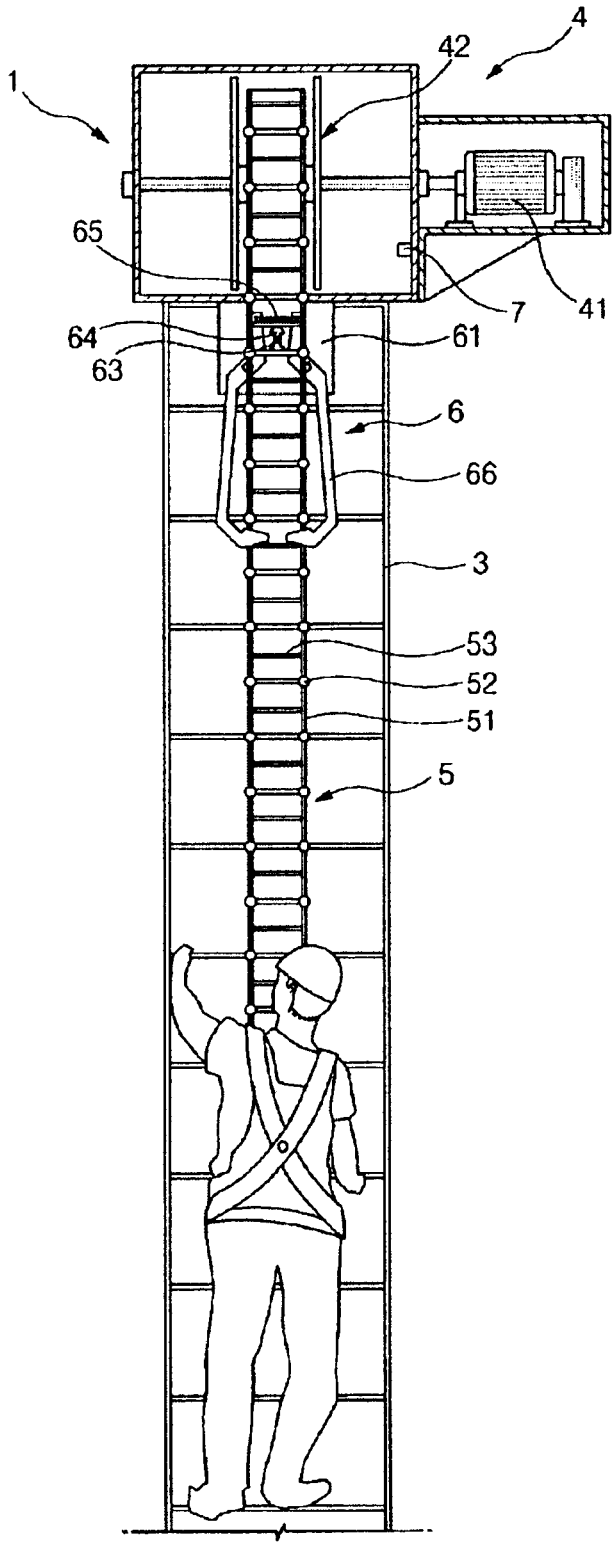
FIG. 1*a* is a front view illustrating the state in which the climbing safety device according to the present invention is installed at a tower crane.
Figure 1B:
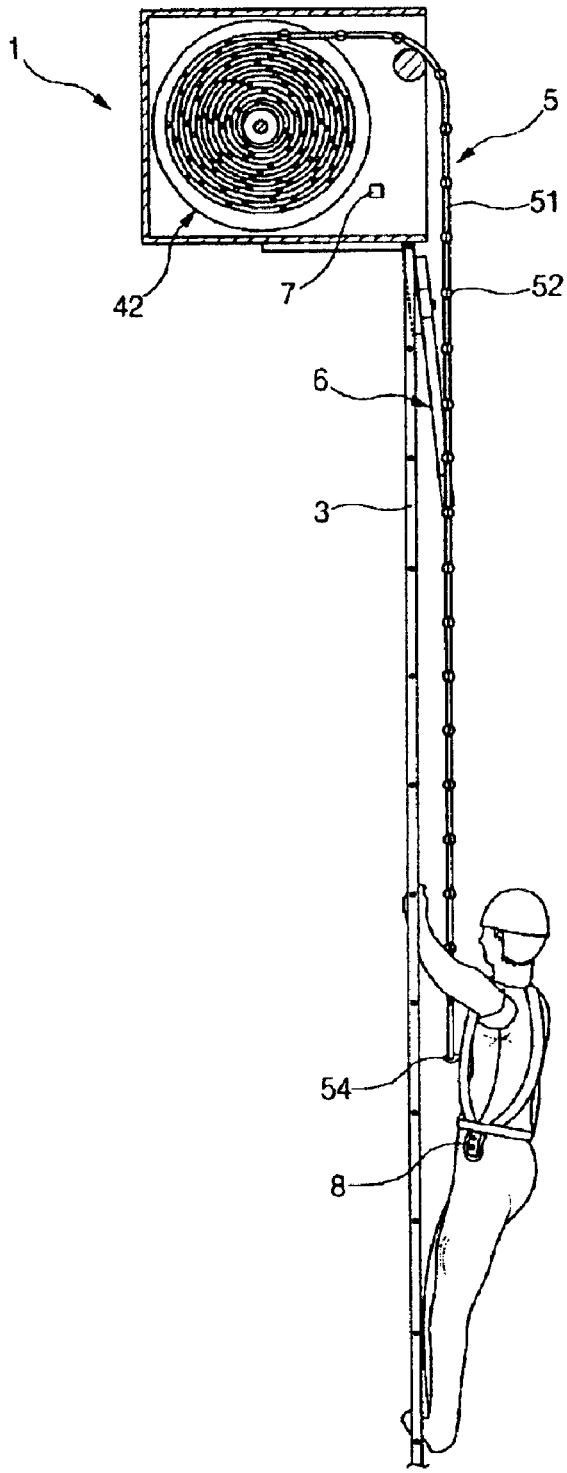
FIG. 1*b* is a side view corresponding to FIG. 1*a;*

FIG. 1*a* is a front view illustrating the state in which the climbing safety device according to the present invention is installed at a tower crane. FIG. 1*b* is a side view corresponding to FIG. 1*a*. Referring to FIGS. 1*a* and 1*b*, a vertical ladder 3 is installed within a mast of the tower crane to extend from a foundation to an overhead operator's cab. As shown in FIGS. 1*a* and 1*b*, the climbing safety device includes a wire rope 5 having a particular structure according to the present invention, which will be described hereinafter. The climbing safety device also includes a wire rope winding unit 4 for winding or unwinding the wire rope 5, and a safety unit 6 for controlling the wire rope 5. The safety unit 6 includes a sensor 7 for sensing a state of the wire rope 5 for the control operation of the safety unit 6.

The wire rope 5 has a ladder-shaped structure including a pair of spaced wires 51, and a plurality of connecting members arranged between the wires 51 while being uniformly longitudinally spaced apart from one another by a certain distance in order to connect the wires 51. The wire rope 5 is fixed, at its upper end, to a winch 42 included in the wire rope winding unit 4, while being provided, at its lower end, with a connecting ring 54 for connecting the wire rope 5 to a safety belt worn by the operator. Each connecting member 53 is made of a metal bar having a sufficient rigidity so that it can pass through tongs 66 included in the safety unit 6 while coming into contact with the tongs 66 when the wire rope 5 moves upwardly or downwardly. A plurality of engagement balls 52 are attached to each wire 51 of the wire rope 5 while being uniformly spaced apart from one another by a certain distance. The engagement balls 52 of the wires 51 are arranged in pairs. Each engagement ball 52 is protruded from the associated wire 51 in a laterally outward direction. When the wire rope 5 is accidentally unwound, one pair of the engagement balls 52 in the wire rope 5 is engaged with the tongs 66 of the safety unit 6 in accordance with an operation of the safety unit 6 based on a sensing operation of the sensor 7, thereby preventing a further unwinding of the wire rope 5.

The wire rope winding unit 4 is installed in a machine room arranged beneath the operator cab. In addition to the winch 42, the wire rope winding unit 4 includes a drive motor 41 adapted to rotate in a forward or backward direction. The winch 42 is operatively connected to the drive motor 41 in order to wind or unwind the wire rope 5. A control unit (not shown) is installed in the machine room. A separate remote controller 8 is also provided to operate the control unit. When the control unit receives a control signal transmitted from the remote controller 8, it controls the drive motor 41 to rotate in a forward or backward direction. In accordance with the rotation of the drive motor 41, the winch 42 winds or unwinds the wire rope 5. The rotating speed of the drive motor 41 can be appropriately set by the remote controller 8 in order to achieve easy and convenient climbing of the operator. Although the drive motor 41 has a rotating speed variable in such a manner, it does not rotate at an excessively high or low speed because its maximum and minimum RPMs are fixedly set.

The tongs 66 included in the safety unit 6 are pivotably mounted, at respective intermediate portions thereof, to a fixing plate 61 fixedly mounted to the mast of the tower crane beneath the wire rope winding unit 4 in such a manner that they come into contact with both sides of the wire rope 5, respectively. In addition to the tongs 66, the safety unit 6 includes a spring 65 mounted between the upper ends of the tongs 66, and adapted to always urge the tongs 66 to widen at their upper ends, thereby narrowing the tongs 66 at their lower ends, while allowing the tongs 66 to elastically pivot between a widened state and a narrowed state as respective contact positions of the tongs contacting the wire rope are shifted, a cam 64 rotatably arranged between the upper ends of the tongs 66, and adapted to selectively come into contact the upper ends of the tongs 66, thereby maintaining the tongs 66 in a narrowed state at their lower ends to stop unwinding of the wire rope 5 when an emergency situation occurs, and a drive motor 62 for rotating the cam 64. The sensor 7, which is also included in the safety unit 7, as described above, senses the RPM of the winch 42 included in the wire rope winding unit 4 and the RPM of the drive motor 41 when an emergency situation occurs, thereby generating a control signal to operate the drive motor 62 and cam 64. The fixing plate 61 serves to fixedly mount the above described elements of the safety unit 6 on the tower crane 1. In accordance with the above described configuration, the safety unit 6 serves as a guide for the wire rope 5 to be easily wound on or unwound from the wire ripe winding unit 4, while serving to immediately stop the unwinding of the wire rope 5 when the wire rope 5 moves rapidly downward in an emergency situation. The spring 65 is in a compressed state, so that the tongs 66 are always urged to narrow at their lower ends by the resilience of the spring 65 tending to extend between the upper ends of the tongs 66.

The tongs 66 are provided at their lower ends with bent portions 67 inwardly bent to face each other, respectively. Each bent portion 67 is formed with a guide hole 68 for guiding upward and downward movements of the wire rope 5 while preventing the downward movement of the wire rope 5 when an emergency situation occurs. The guide hole 68 includes a wire hole 68' and a ball hole 68" connected to each other. Each bent portion 67 is opened at its terminal end to form an opening extending to the ball hole 68" while having a width smaller than that of the ball hole 68", in order to allow the connecting members 53 of the wire rope 5 to pass therethrough while preventing the engagement balls 52 from being separated from the guide hole 68 during the upward and downward movements of the wire rope 5. Each bent portion 67 has an upper surface inclined downwardly while extending toward the terminal end of the bent portion 67, and a lower surface inclined upwardly while extending toward the terminal end of the bent portion 67, so that the engagement balls 52 can smoothly pass through the ball holes 68" while sliding on the upper or lower inclined surface.

Figure 2A:
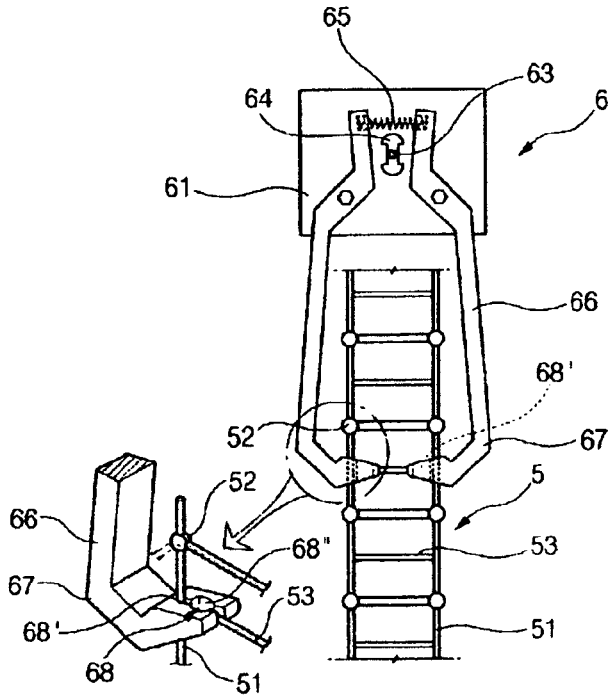
FIG. 2*a* is a front view illustrating a state in which wires of a wire rope pass through respective wire holes formed at bent portions of tongs when a wire rope winding unit included in the climbing safety device operates normally.
Figure 2B:
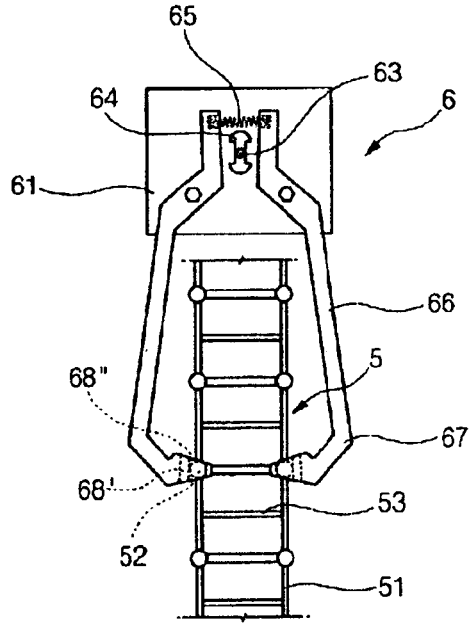
FIG. 2*b* is a front view illustrating a state in which engagement balls of the wire rope pass through respective ball holes formed at the bent portions of the tongs when the climbing safety device operates, as in FIG. 2*a;*
Figure 3:
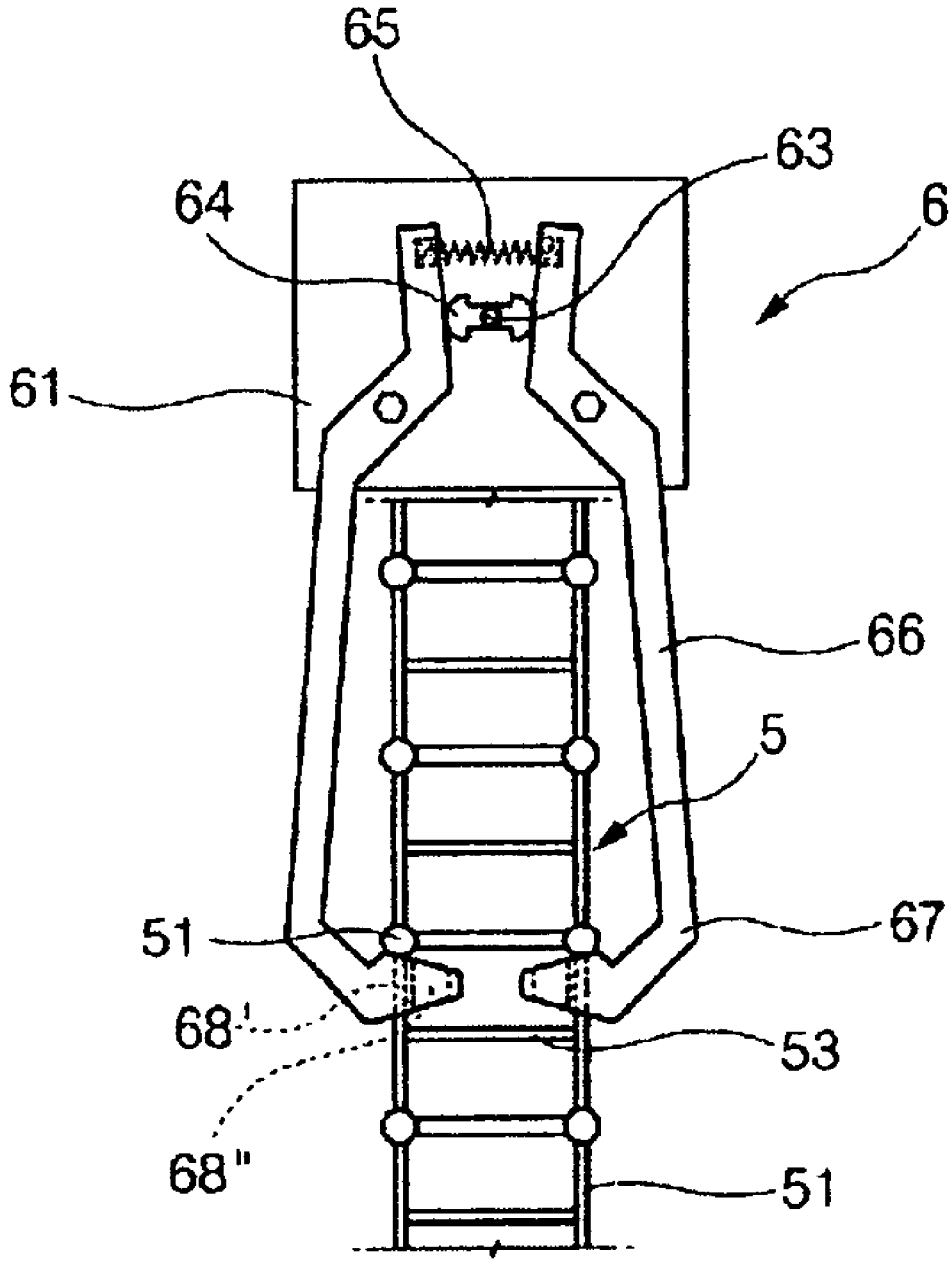
FIG. 3 is a front view illustrating a state in which selected ones of the engagement balls are engaged with respective wire holes of the tongs in accordance with operation of a safety unit included in the climbing safety device when the wire rope winding unit operates abnormally.
Figure 4:
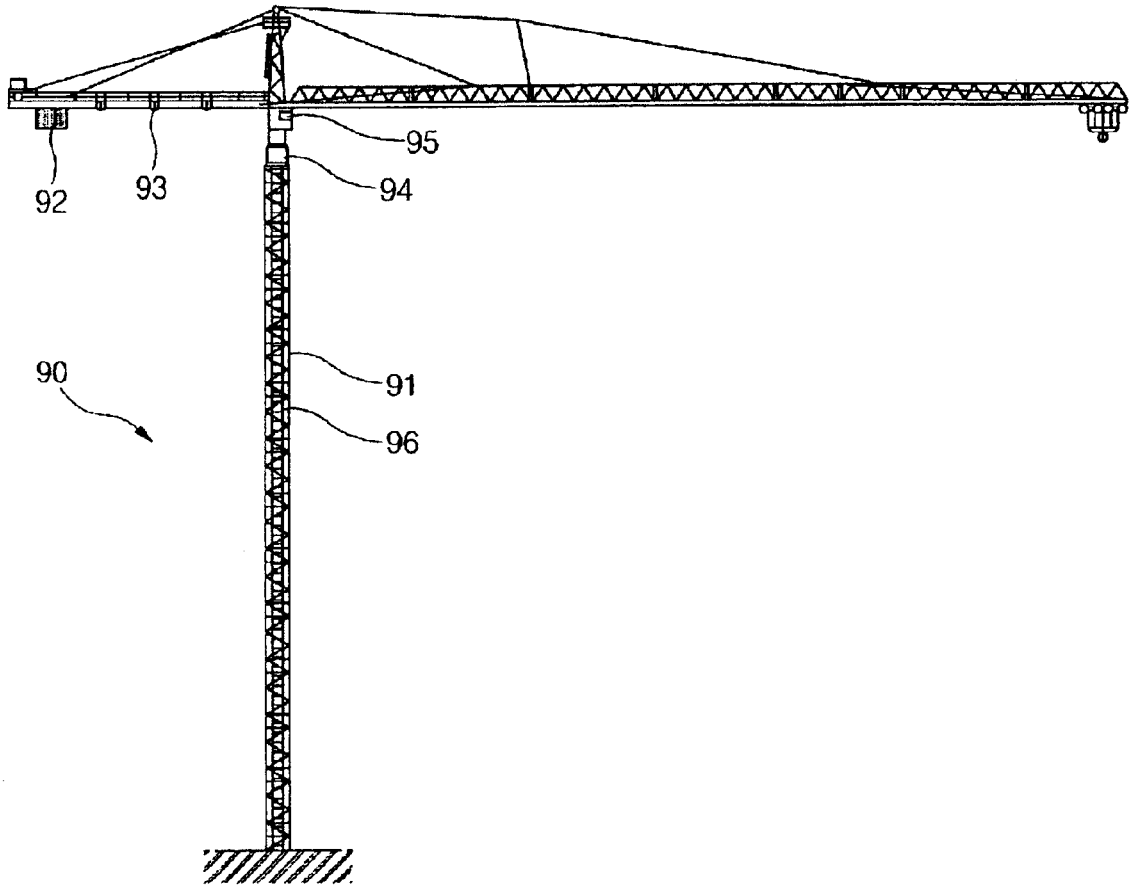
FIG. 4 is a schematic view illustrating a tower crane equipped with a conventional climbing safety device.

When the wire rope winding unit 4 operates normally, the cam 64 is maintained in a vertical state in which the spring 65 is freely maintained. In this state, the tongs 65, which is pivotably mounted to the tower crane 1 by the fixing plate 61, is repeatedly elastically widened and narrowed by the spring force of the spring 65 in accordance with a variation in the contact position thereof with the wire rope 5 during the upward or downward movement of the wire rope 5 therebetween, thereby allowing the wire rope 5 to be smoothly moved. That is, when the wire rope 5 is upwardly or downwardly moved by a drawing force of the drive motor 41 or operator under the condition in which each wire 51 of the wire rope 5 passes through the associated guide hole 68, the tongs 66 are first widened at their upper ends by the resilience of the spring 65, thereby causing the bent portions 67 to narrow, as shown in FIG. 2*a*. At this time, each wire 51 of the wire rope 5 passes through the associated wire hole 68'. When one engagement ball 52 of the wire rope 5 subsequently reaches the associated bent portion 67 to pass through the associated guide hole 68, it comes into contact with the upper or lower inclined surface of the bent portion 67 around the wire hole 68' because it is larger than the wire hole 68'. Accordingly, the force of the operator or drive motor 41 drawing the wire rope 5 is applied to the bent portion 67. As a result, the tongs 66 are widened at the bent portions 67 while being narrowed at their upper ends, thereby causing the spring 5 to be compressed. Simultaneously, the engagement ball 52 contacting the associated bent portion 67 slides along the upper or lower inclined surface of the bent portion 67 to the associated ball hole 68", and then passes through the ball hole 68". Thus, the wire rope 5 is smoothly wound or unwound.

On the other hand, when the wire rope winding unit 4 operates abnormally, that is, when the winch 42 of the wire rope winding unit 4 rotates rapidly beyond a predetermined rotating speed range of the drive motor 41, this situation is sensed by the sensor 7 which, in turn, immediately sends a control signal to the drive motor 62 of the safety unit 6. In response to the control signal, the drive motor 62 immediately rotates 90°. In accordance with the 90° rotation of the drive motor 62, the cam 64 also rotates 90° to be in a horizontal state because it is fixed to a rotating shaft 63 of the drive motor 62. In the horizontal state, the cam comes into contact with the inner surfaces of the upper ends of the tongs 66, thereby fixing the tongs 66. In this fixed state, the bent portions 67 of the tongs 66 are maintained in a narrowed state. Accordingly, the guide hole 68 of each bent portion 67 is inwardly shifted in a horizontal direction, so that the associated wire 51 of the wire rope 5 is received in the wire hole 68' of the guide hole 68. Subsequently, one engagement ball 52 of the wire rope 5, which has an outer diameter larger than the inner diameter of the wire hole 68', comes into contact with the wire hole 68', thereby preventing the wire rope 5 from being further unwound.

Preferably, the cam 64 has a length larger than the width of a gap defined between the upper ends of the tongs widened by the spring 65. Accordingly, when the cam 64 rotates to a horizontal state in accordance with a 90° rotation of the drive motor 62, it extends the spring 65 to an extent larger than the extension extent of the spring 65 in a free state in which no external force is applied to the spring 65. That is, the cam 64 further widens the gap defined between the upper ends of the tongs 66, and further narrows the bent portions 67 of the tongs 66. The cam 64 maintains the tongs 64 in this state. Thus, the engagement ball 52 of the wire rope 5 can be more reliably engaged with the wire hole 68'.

When the operator desires to climb up the ladder 3 of the tower crane equipped with the climbing safety device according to the present invention in order to access the operator cab of the tower crane, he first firmly connects the connecting ring 54 provided at the lower end of the wire rope 5 to a safety belt worn by the operator. Thereafter, the operator climbs up the ladder 3 while operating the drive motor 41 by the remote controller 8. As the drive motor 41 operates, the winch 42 rotates, thereby drawing the wire rope 5. In accordance with the drawing force of the drive motor 41, the wire rope 5 is upwardly moved in a state in which its wires 51 are received in the guide holes 68 formed at the bent portions 67 of the tongs 66, respectively. At this time, the spring 65 of the safety unit 6 is in a free state. Accordingly, the wires 51 of the wire rope 5 can be easily raised through the wire holes 68' of the guide holes 68, respectively. Subsequently, the engagement balls 52, which reach the wire holes 68', slide along the lower inclined surfaces of the bent portions 67 to the ball holes 68", respectively, while narrowing the bent portions 67 of the tongs 66 by the drawing force of the drive motor 41. As a result, the engagement balls 52 pass through the ball holes 68", respectively, thereby allowing the wire rope 5 to be wound on the winch 42. Thus, the operator can easily and safely climb up the ladder 3 to reach the operator cab as the wire rope 5 is correspondingly wound on the winch 42. After reaching the operator cab, the operator stops the drive motor 41 by operating the remote controller 8. When the operator climbs down the ladder 3 after exiting the operator cab, the same operations as described above are carried out.

Meanwhile, the operator may fall off the ladder 3 when he climbs up or down the ladder 3, due to his slip such as missing of his footing on the ladder or his failure to grasp the ladder, a sudden change of weather conditions in the winter or rainy season, strong wind, or an external impact. At this time, the wire rope 5 descends rapidly by the weight of the operator. However, the descending speed of the wire rope 5 is gradually reduced because the engagement balls 52 arranged at both sides of the wire rope 5 are sequentially engaged with the guide holes 68 of the tongs 66. When such an unexpected accident occurs, the sensor 7 immediately senses this accident, and sends a desired control signal to the safety unit 6 to operate the drive motor 64, thereby causing the cam 64 to rotate 90°. In accordance with this rotation, the cam 64 is shifted to a horizontal state, thereby extending the spring 65 to an extent larger than the extension extent of the spring 65 in a free state. Simultaneously, the cam 64 widens the upper ends of the tongs 66 while narrowing bent portions 67 of the tongs 66, and maintains the tongs 66 in this state. As a result, the guide holes 68 of the bent portions 67 are inwardly horizontally shifted, so that the wires 51 of the wire rope 5 are received in the wire holes 68' of the guide holes 68, respectively. Subsequently, the engagement balls 52, which reach the wire holes 68', are engaged with the wire holes 68', thereby stopping the unwinding of the wire rope 5. Accordingly, it is possible to cope with the accident of the operator falling off the ladder.

As apparent from the above description, the present invention provides a climbing safety device for a tower crane which can provide a sense of security to the operator climbing up or down the tower crane by a wire rope adapted to be wound and unwound at a constant speed, and a safety unit adapted to control the wire rope while guiding the wire rope, while immediately stopping the unwinding of the wire rope when the operator falls off a ladder of the tower crane, by operating the safety unit under the control of a sensor sensing the falling of the operator, thereby being capable of protecting the operator's life. The climbing safety device also has a simple construction, so that it can be inexpensively installed. Accordingly, the climbing safety device is cost-effective.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. In a tower crane including a vertical ladder enabling an operator to move to an overhead operator cab, and a wire rope serving as safety means for the operator, a climbing safety device comprising:

a wire rope winding unit installed at an upper portion of the tower crane, the wire rope winding unit including a drive motor adapted to freely rotate in a forward or backward direction, thereby winding or unwinding the wire rope, and a winch operatively connected to the drive motor;

the wire rope having a ladder structure to have wires at both sides thereof, respectively, while being provided, at each side thereof, with engagement balls vertically spaced apart from one another along an associated one of the wires, the wire rope being fixed, at one end thereof, to the winch so as to be wound on the winch, and provided, at the other end thereof, with a connecting ring for connecting the wire rope to a certain body portion of the operator; and a safety unit installed beneath the wire rope winding unit, and adapted to guide a movement of the wire rope while controlling a sudden unwinding of the wire rope, the safety unit including a sensor for sensing the sudden unwinding of the wire rope.

2. The climbing safety device according to claim 1, wherein the safety unit comprises:

a pair of tongs contacting the wires of the wire rope, respectively, to guide or control the wire rope, while being pivotable about respective intermediate portions thereof to widen or narrow at upper or lower ends thereof, each of the tongs being provided, at the lower end thereof, with a bent portion contacting an associated one of the wires while having upper and lower inclined surfaces;

a spring interposed between upper ends of the tongs, and adapted to allow the tongs to elastically pivot between a widened state and a narrowed state as respective contact positions of the tongs contacting the wire rope are shifted along the upper or lower inclined surfaces of the bent portions;

a cam rotatably arranged between the upper ends of the tongs, and adapted to selectively come into contact with the upper ends of the tongs, thereby maintaining the tongs in a narrowed state at the bent portions thereof; and a drive motor for rotating the cam in response to a sensing signal generated from the sensor, thereby causing the cam to come into contact with the upper ends of the tongs.

3. The climbing safety device according to claim 2, wherein the bent portions are formed with guide holes for guiding movements of the wires and engagement balls of the wire rope, respectively, or engaging with selected ones of the engagement balls when an emergency situation occurs, each of the guide holes including a wire hole and a ball hole connected to each other.

4. The climbing safety device according to claim 1, further comprising:

a remote controller for controlling a rotating speed of the drive motor in the wire rope winding unit.

* * * * *